US005601474A

United States Patent [19]

Takahashi

[11] Patent Number: 5,601,474

[45] Date of Patent: Feb. 11, 1997

[54] POLISHING DISC OF SPHERICAL SURFACE POLISHING DEVICE FOR OPTICAL FIBER END SURFACE AND METHOD FOR POLISHING SPHERICAL SURFACE OF OPTICAL FIBER END SURFACE

[75] Inventor: Mitsuo Takahashi, Matsudo, Japan

[73] Assignee: Seikoh Giken Co., Ltd., Chiba-ken, Japan

[21] Appl. No.: 350,523

[22] Filed: Dec. 7, 1994

[30] Foreign Application Priority Data

Jul. 13, 1994 [JP] Japan ..... 6-184060

[51] Int. Cl.[6] ..... B24B 1/00

[52] U.S. Cl. ..... 451/28; 451/41; 451/42; 451/271; 451/550

[58] Field of Search ..... 451/921, 41, 42, 451/43, 530, 539, 439, 550, 271, 285

[56] References Cited

U.S. PATENT DOCUMENTS

| | | | |
|---|---|---|---|
| 4,979,334 | 12/1990 | Takahashi . | |
| 5,216,843 | 6/1993 | Breivogel et al. | 451/550 |
| 5,349,784 | 9/1994 | Grois et al. | 451/41 |
| 5,351,445 | 10/1994 | Takahashi | 451/41 |
| 5,458,531 | 10/1995 | Matsuoka et al. | 451/271 |
| 5,464,361 | 11/1995 | Suzuki et al. | 451/42 |
| 5,480,344 | 1/1996 | Xu et al. | 451/42 |

FOREIGN PATENT DOCUMENTS

| | | | |
|---|---|---|---|
| 362140755 | 6/1987 | Japan | 451/439 |
| 62-173159 | 7/1987 | Japan . | |
| 62-176748 | 8/1987 | Japan | 451/439 |
| 3-81708 | 4/1991 | Japan . | |

*Primary Examiner*—Bruce M. Kisliuk
*Assistant Examiner*—George Nguyen
*Attorney, Agent, or Firm*—Spencer & Frank

[57] ABSTRACT

A polishing disc of spherical polishing device for polishing optical end surface capable of minimizing optical loss due to reflection in a returning direction. With this polishing disc of polishing device for polishing a spherical surface on optical fiber end surface, a tip end of a ferrule supporting an optical fiber is pressed against a surface of the polishing disc and a relative movement for polishing is caused between the ferrule tip end and the polishing disc surface to polish a tip end of the optical fiber into a spherical surface. The polishing disc A is constituted by a flat plate made of an elastic material and a soft plastic film which is provided on said flat plate as a film surface without containing abrasive and which has rugged patterns having a surface roughness of several microns or less. The surface of the soft plastic film is preferably a rough surface having rugged patterns of a surface roughness of 2 μm or less.

8 Claims, 4 Drawing Sheets

POLISHING DISC OF SPHERICAL SURFACE POLISHING DEVICE FOR OPTICAL FIBER END SURFACE AND METHOD FOR POLISHING SPHERICAL SURFACE OF OPTICAL FIBER END SURFACE

BACKGROUND OF THE INVENTION

1. Field of the Invention

The present invention relates to a polishing disc suitable for polishing an optical fiber end surface into a spherical surface and method for polishing a spherical surface using such polishing disc.

2. Prior Art

Various proposals have been made with respect to polishing devices and polishing discs for polishing an end surface of an optical fiber into a spherical surface.

Spherical polishing of an optical fiber end surface may be achieved by using an apparatus according to patent applications (Japanese Patent Laid-Open No. 62-173159/1987) "method of processing an end surface of rod and apparatus therefor" by Nippon Telegraph and Telephone, and (Japanese Patent Laid-Open 3-81708/1991) "polishing method of ultra low reflection optical connector ferrule" by the same.

These polishing devices will be briefly described below with reference to FIG. 5 and FIG. 5A.

An optical fiber 2 of which the tip end is to be polished into a spherical surface is inserted into the center hole of a ferrule 1 and is adhered thereto. The ferrule 1 is then supported by a ferrule holder 9 and its tip end is pressed against a polishing plate which will be described later.

The ferrule 1 is turned through a turning angle of 180° both left and right in a reciprocating manner as indicated by arrows by means of a driver mechanism (not shown).

As shown, a tip end surface 3 of the ferrule 1 is formed in a pre-processing procedure into the shape of a cone. A hollow rotating drum 4 which rotates at a high speed is formed integrally with a rotating shaft 5 at its center. A hard plastic film disc 6 is held at its peripheral portion 7 by a holding ring member 8 so as to be mounted on the hollow rotating drum 4.

Since a ferrule tip end 10 is pressed against the hard plastic film disc 6 by a polishing load (P), the portion of a contacting point Q between the plastic film disc 6 and the ferrule tip end 10 is locally deformed to have a section exhibiting a circular arc.

In this state, by effecting the reciprocating turning of the ferrule 1 while dropping abrasive 11 on the upper surface of the plastic film disc 6, a fine portion at the apex of the cone tip of the ferrule 1 is polished into a spherical surface.

Furthermore, the present inventor has proposed "OPTICAL FIBER END-SURFACE POLISHING DEVICE" (Japanese Patent Laid-Open No. 3-26456/1991: U.S. Pat. No. 4,979,334). An optical fiber end surface may be polished into a spherical surface by using the polishing device. This apparatus will be described below with reference to FIG. 6.

The tip end of a ferrule 13 having a center hole into which an optical fiber 12 is inserted and fixed by means of adhesion is pressed against a polishing disc and is polished by a relative movement for polishing.

A turn table 14 revolving at a high speed describes a circular locus having a rotating radius R around the center of revolution at a center axis 15. The turntable is rotated by means of a driver mechanism (not shown), and at the same time is caused to rotate on its own axis at a very low speed. A polishing plate 16 of an elastic material is placed on an upper surface of the turn table 14, and a polishing film 17 having a soft plastic film surface with abrasive applied thereon is pasted onto the upper surface of the polishing plate 16.

While being pressed against the surface of the polishing film 17 by a polishing load (W), a tip end surface 18 of the ferrule 13 is urged downward and held still by a ferrule holder 19, and, in this state, polishing is effected by causing the turn table 14 to both revolve and rotate.

Accordingly, the tip end surface 18 of the ferrule 13 is concentrically polished and first removed, as the polishing load acts is the outer periphery of the end surface of the ferrule 13, due to the fact that the surface of the polishing film 17 is pressurized to cause a flexible deformation by the polishing load (W). The polishing and removing process gradually proceeds toward the center of the ferrule 13. When a uniform polishing pressure acting upon the end surface of the ferrule 13 has been achieved, the end surface of the ferrule 13 is formed into a spherical surface and the spherical polishing is completed.

In general, polishing and removing ability of the plastic film disc used in the polishing device as described with reference to FIGS. 5 and 5A is extremely low due to its structure.

In the above described apparatus of the conventional example, therefore, in order to supplement the polishing and removing ability of the plastic film disc 6, the tip end 10 of the ferrule 1 is previously formed into the shape of a cone and the portion to be polished and removed by the plastic film disc 6 is limited to a fine portion at the tip end of the cone. On the other hand, it is known that the amount of light reflection occurring at the optical fiber end surface is increased in proportion to the polished surface roughness of that surface. It is also known that, in addition to the grain size and material of abrasive grains, the polishing pressure largely affects a reduction in the roughness of the polished surface.

However, in this conventional example where the polishing area of the tip end portion of the ferrule 1 is a very small pinpoint-like area having a diameter on the order of 100 μm, a fine pressure control for properly keeping the required polishing pressure is next to impossible. If the polishing pressure is not suitable, small scratches occur on the polished surface and it is thus difficult to obtain an excellent polished surface.

It may be said that optical loss due to reflection in a returning direction obtained by this conventional polishing method is on the order of 40 dB, and an optical loss due to reflection in a returning direction of 55 dB cannot be achieved, which is thought to be required in a large capacity optical fiber communication in the future.

In the conventional apparatus according to the proposal by the present inventor as described with reference to FIG. 6, the tip end diameter of the ferrule 13 is generally regulated to 1.2~1.9 mm to provide a sufficient tip end area for the fine adjustment of the polishing pressure (W), and the polishing film 17 is retained by a thick polishing plate 16.

Accordingly, since a relatively large polishing force (W) may be used, fine adjustment of the pressure is easier compared to the foregoing example.

When, for purpose of comparison, a polishing film having equivalent abrasive grains as that in the example of FIGS. 5 and 5A is used, optical loss due to reflection return occurring at the end surface of an optical fiber was generally 48 dB, showing a great improvement. It was difficult, however, to stably obtain 50 dB or above.

One of the reasons why optical loss due to reflection return cannot be reduced as described is presumably because of deterioration in the polishing boundary conditions, which occurs as the polishing process proceeds because of the structure of the polishing film.

FIG. 4 shows an enlarged sectional view of a polishing film having a base made of an ordinary plastic film. This polishing film is manufactured such that an abrasive powder 21 is mixed with a resinous adhesive binder agent 22, is applied uniformly in a thin layer, and then dried on one surface of a plastic film 20. When behavior of the polishing film at the time of polishing of the ferrule is observed, the lower surface of the ferrule and the polishing film surface are slid relative to each other in the state where a polishing pressure is continuously added. As the lower surface of the ferrule is gradually polished and removed, the applied layer of the abrasive grains 21 on the polishing film, too, is gradually removed at the same time.

It was thus found that, as the polishing process proceeds, powders removed from the ferrule, free abrasive grains or resinous binder agent, etc., which have been scrubbed off and pulverized, are joined together to form an accumulation of fine masses and at the same time are irregularly buried in the adhesive binder agent on the polishing film surface. Thus, the surface roughness of the polishing film becomes nonuniform and is rapidly degraded. Further, the abrasives adhere to the periphery of a chip scrubbed from the resinous adhesive binder agent to form a free abrasive grain having a large apparent diameter. This is harmful.

Therefore, with the conventional method using a polishing film having abrasive grains applied thereon, the ferrule end surface is polished by a polishing film surface which is degraded as the polishing process proceeds and, as a result, there is a limit in the smoothness of the polished surface.

As described, spheric polishing at the tip end of an optical fiber by a typical conventional optical fiber end surface polishing device is with limitation, and it has been impossible to stably achieve a reflection return optical loss of 50 dB or above.

Returning light by reflection occurring due to the roughness in the polished surface of the connecting end surface of the optical fiber must be minimized, since the operation of a laser source becomes unstable when it is fed back to the laser source. In the case of a high speed, large capacity optical communication system, a reflection return optical loss of 50 dB or above is required. In order to satisfy this requirement, spheric polishing of the optical fiber end surface must be done to such an extent that the reflection return optical loss is 50 dB or above.

SUMMARY OF THE INVENTION

Accordingly, it is an object of the present invention to provide a polishing disc of a spherical surface polishing device for an optical fiber end surface by which optical loss due to reflection in a returning direction is minimal.

It is another object of the present invention to provide a method for polishing a spherical surface on an optical fiber end surface, minimizing optical loss thereat due to reflection in a returning direction.

To achieve the above objects, a polishing disc of a spherical surface polishing device for an optical fiber end surface is provided in accordance with the present invention. In the polishing disc, a tip end of a ferrule supporting an optical fiber is pressed against a surface of the polishing disc and a relative movement for polishing is caused between the ferrule tip end and the polishing disc surface to polish a tip end surface of the optical fiber into a spherical surface. The polishing disc comprises: a flat plate made of an elastic material; and a soft plastic film surface that does not contain abrasive, provided over the flat plate as a rough surface having a rugged pattern having a surface roughness of several microns or less.

The soft plastic film surface is preferably provided as a rough surface having rugged patterns of a surface roughness of 2 μm or less.

The relative movement for polishing may be a synthetic movement consisting of a revolving movement of the disc around a point, and a rotational movement of the disc on its own axis.

To achieve the above objects, a method for polishing a spherical surface of an optical fiber end surface is provided in accordance with the present invention. The method for polishing a spherical surface of the optical fiber end surface uses a spherical surface polishing device for the optical fiber end surface in which a tip end of a ferrule supporting an optical fiber is pressed against the surface of a polishing disc and a relative movement for polishing is caused between the ferrule tip end and the polishing disc surface to polish the optical fiber tip end into a spherical surface. The method comprises the steps of: using a polishing disc for polishing a spherical surface of an optical fiber end surface having a flat plate made of an elastic material, and a soft plastic film surface that does not contain abrasive, provided over the flat plate as a rough surface having rugged patterns having a surface roughness of several microns or less; and effecting polishing while spreading fine abrasive grains and a processing liquid over the rough surface of the soft plastic film.

In the above method for polishing a spherical surface on the optical fiber end surface, the grain size of the abrasive in a final polishing process is preferably 0.5 μm or less.

In the above method for polishing a spherical surface of the optical fiber end surface, the abrasive is preferably one of a fine powder of alumina ($Al_2O_3$), or a powder of oxide silica ($SiO_2$), or carbide silica (SIC).

DESCRIPTION OF THE PREFERRED EMBODIMENT

The present invention will now be described in more detail with reference to the drawings.

Figure 1:
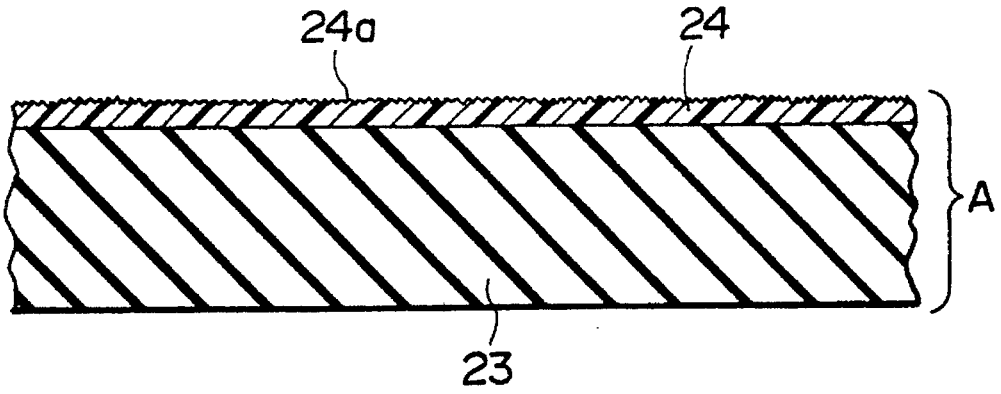
FIG. 1 is an enlarged sectional view showing an embodiment of a polishing disc according to the present invention, for use in a spherical surface polishing device for an optical fiber end surface.

FIG. 1 shows an embodiment of a spherical polishing disc for an optical fiber end surface according to the present invention. The spherical polishing disc A is constituted by pasting a polishing film 24 to the upper surface of an elastic plate 23. The elastic material plate 23 is formed from elastic materials, such as a synthetic rubber. The polishing film 24 is of soft plastics and its surface 24*a* is formed by providing fine rugged patterns having a surface roughness on the order of 0.2~1 μm all over the surface.

Figure 2:
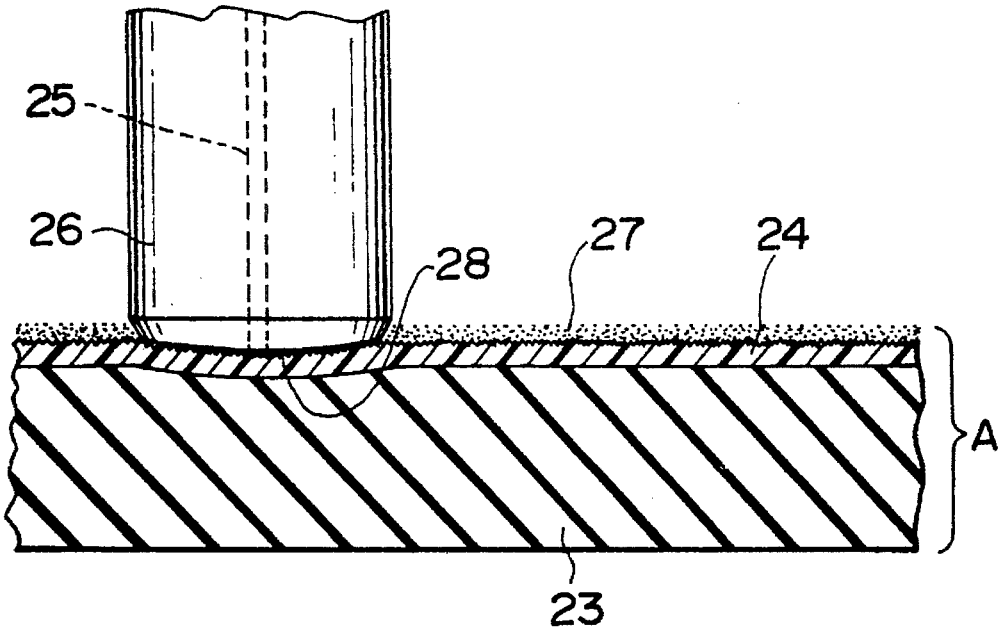
FIG. 2 illustrates the manner of polishing a ferrule set with an optical fiber using the disc of the above embodiment.

FIG. 2 shows the manner by which a ferrule 26 set with an optical fiber 25 is polished by the spherical polishing disc A according to the present embodiment. The polishing method will now be described with reference to the drawings.

First, a small amount of abrasive 27 diluted into a processing liquid is dropped over the surface of the soft plastic film 24. A powder of oxide silica ($SiO_2$), or carbide silica (SIC), or powder alumina ($Al_2O_3$) is suitable as the abrasive.

Thereafter, the polishing disc A is pressed against a lower surface 28 of the ferrule 26 set with the optical fiber 25 which is attached to a ferrule holder having an optional structure (not shown).

A relative movement is then caused between the ferrule 26 set with the optical fiber 25 and the spherical polishing disc A, such that a locus describing a circular arc is drawn in relation to each other between the lower surface 28 of the ferrule 26 and the spherical polishing disc A.

By this relative movement, the lower surface 28 of the ferrule 26 set with the optical fiber 25 is polished and formed into a spherical surface. Since, unlike a conventional polishing film, the soft plastic film 24 of the spherical polishing disc A according to the present invention does not contain resinous adhesive binder agent, only powders of removed materials resulting from the polishing of the ferrule 26, the processing liquid, and a small amount of the abrasive 27 are present on the surface of the polishing film 24 even after the polishing process has proceeded.

Figure 4:
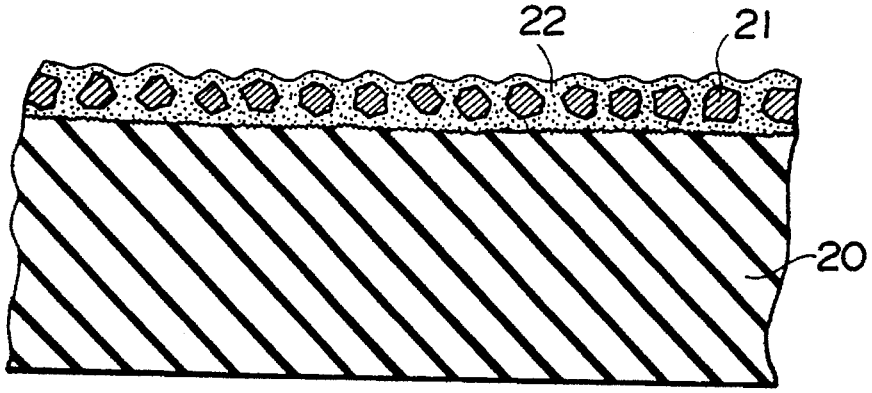
FIG. 4 PRIOR ART
FIG. 4 is an enlarged sectional view of a conventional polishing film having a base consisting of an ordinary plastic film.
Figures 5, 5A:
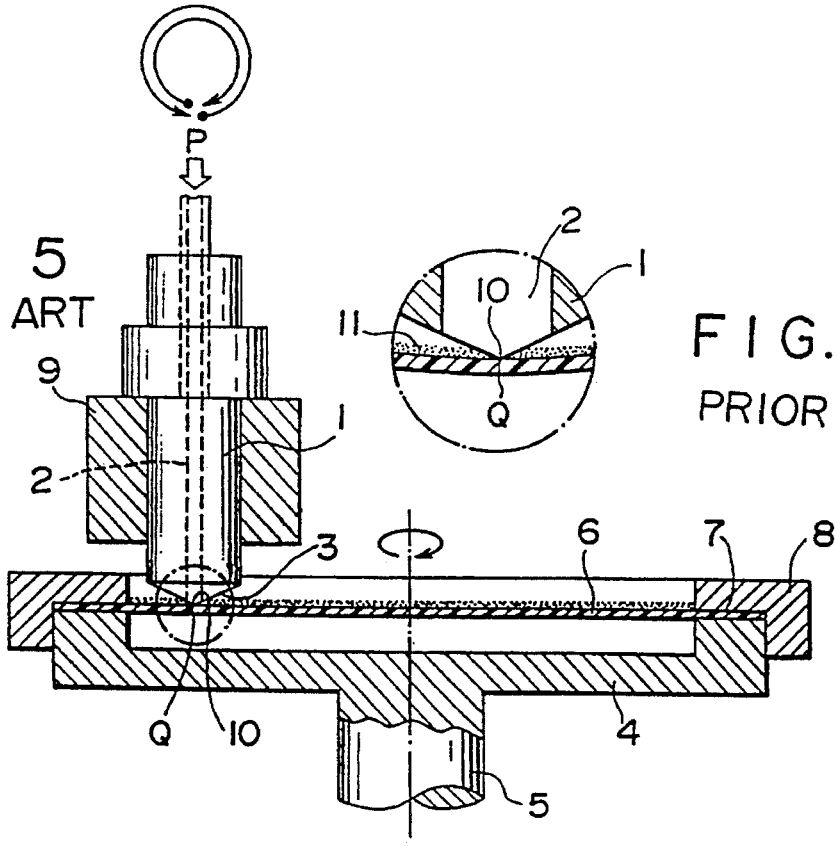
FIG. 5 PRIOR ART
FIG. 5A PRIOR ART
FIGS. 5 and 5A schematically illustrate a prior art example of a device for polishing an optical fiber end surface into a spherical surface.
Figure 6:
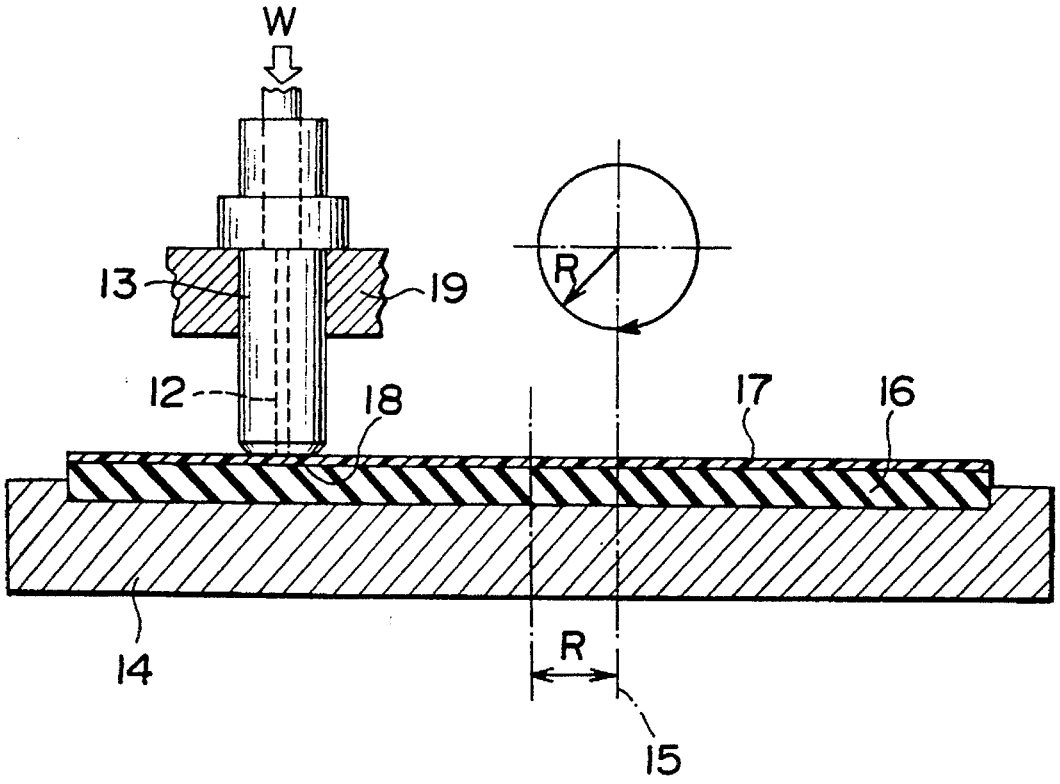
FIG. 6 PRIOR ART
FIG. 6 illustrates another prior art example of a device for polishing an optical fiber end surface into a spherical surface.

For this reason, the harmful resinous adhesive binder agent 22 and abrasive grains 21 scrubbed off in the conventional device (FIG. 4) are not presently on the polishing surface.

An oxide silica ($SiO_2$) powder having a grain size of 0.5 μm or less was used as the abrasive for the finishing process 1 and the polishing is performed under a polishing pressure of 200 gr/mm$^2$.

Figure 3:
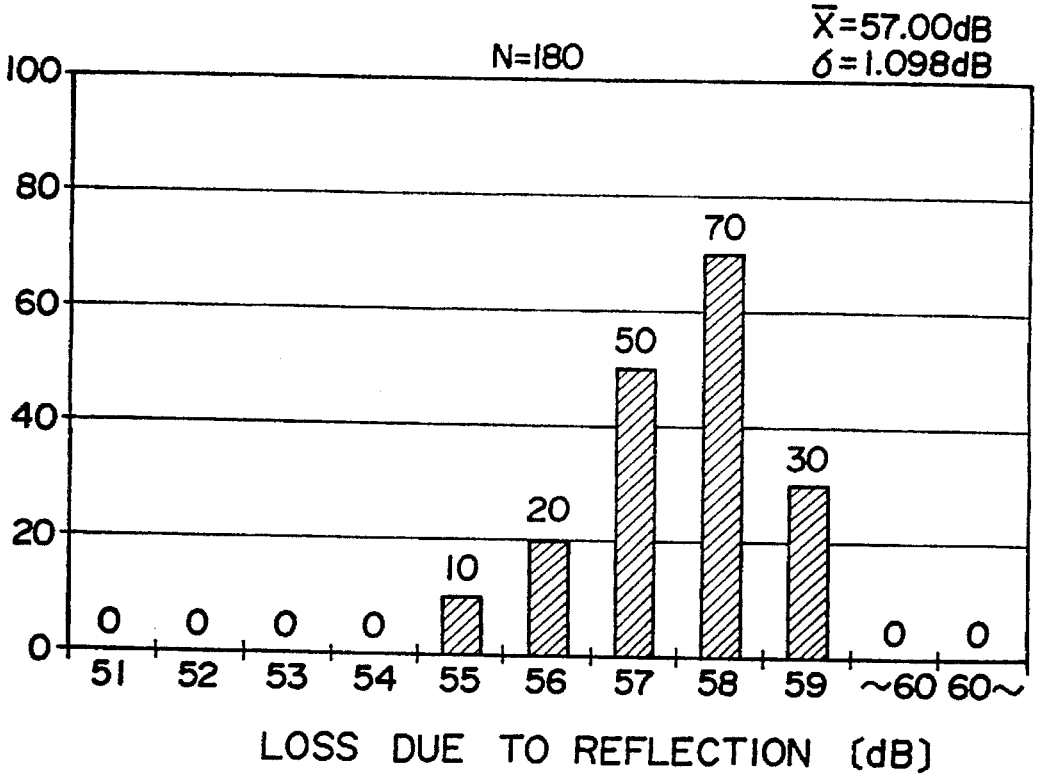
FIG. 3 is a graph showing distribution of optical losses due to reflection return at the optical fiber end surfaces polished by using the disc of the above embodiment.

Distribution of optical losses due to reflection return obtained at this time is shown in FIG. 3. An average reflection return optical loss at the polished end surface of 55 dB or above is stably obtained.

A first reason for making such an excellent polishing possible may be understood as follows. That is, since fine rugged patterns are provided as described on the surface of the polishing film 24, polishing is effected in the state where the abrasive 27 is buried in the concave portion of the rough surface and the powder removed as a result of polishing of the ferrule 26 and excessive abrasive may be caused to escape into the concave portion.

Accordingly, in the case where the spherical polishing disc A of the present invention is used, it is possible to maintain extremely stable and excellent polishing boundary conditions even after the polishing process has proceeded.

Since the reflection return optical loss characteristic depends on the material, the selection of grain size and quality of the abrasive to be used in the final polishing process is important. A fine powder of alumina ($Al_2O_3$) or a powder of oxide silica ($SiO_2$) or carbide silica (SIC) having a grain size of 0.5 μm or less is suitable as the abrasive for the finishing process.

If a diamond powder is used in polishing a quartz material optical fiber, fine scratches tend to occur. It is not particularly preferable because of a limitation in performance regarding the reflection return optical loss and also because it is expensive.

Cerium oxide ($SeO_2$), which is frequently used in finishing of the polishing process of an optical lens, is excellent in view of the roughness of the polishing surface. However, it cannot be used if the ferrule is of a zirconia ceramic material, since it is largely different in hardness from the optical fiber and it excessively polishes and removes only the optical fiber and causes the optical fiber end surface to be depressed from the ferrule end surface.

The spherical polishing disc for the optical fiber end surface of the present invention makes possible polishing of an optical fiber end surface with a simple construction while stabilizing polishing boundary conditions during the polishing. In addition, since the polishing area on the ferrule end surface is made relatively larger and the polishing film is retained on an elastic disc surface, it is also easy to effect a fine adjustment for achieving an optimal value of polishing pressure which is important in improving the quality of roughness of the polishing surface. As a result, optical loss due to reflection in a returning direction is greatly improved from the order of 30~40 dB to an average of 55 dB.

Of course, the present apparatus may be used in manual polishing. In addition, it is also suitable for mass production, since it may be naturally applied in place of the polishing disc in a polishing device according to the invention by the present applicant as described above. Since additional steps in processing and an increase in costs are not required, improvement in productivity and economical advantage are substantial.

What is claimed is:

1. A polishing device for polishing a tip end surface of an optical fiber into a spherical shape, the optical fiber being supported by a ferrule, the device comprising:

a polishing disc, comprising:

a flat base plate comprised of an elastic material, and a soft, abrasive-free plastic film adhered to said flat base plate, and having a rough surface formed by a rugged pattern, the rough surface having a surface roughness of 0.2 to 1 micron; and an abrasive powder supplied to said polishing disc and being retainable by the rough surface, wherein the tip end surface of the optical fiber is polished by pressing the optical fiber against said polishing disc, and causing a relative movement between the tip end surface and said polishing disc.

2. A polishing device according to claim 1, wherein the relative movement for polishing is a movement consisting of a rotation of said polishing disc about its own axis, and a revolving of said polishing disc around a point.

3. A polishing device according to claim 1, wherein a grain size of said abrasive powder is 0.5 μm or less.

4. A polishing device according to claim 1, wherein said abrasive powder includes one of a fine powder of alumina ($Al_2O_3$), a powder of oxide silica ($SiO_2$), and a powder of carbide silica (SiC).

5. A method of polishing a tip end surface of an optical fiber into a spherical shape, the optical fiber being supported by a ferrule, comprising the steps of:

providing a polishing disc, including a flat base plate comprised of an elastic material, and a soft, abrasive-free plastic film adhered to the flat base plate, the plastic film having a rough surface formed by a rugged pattern, the rough surface having a surface roughness of 0.2 to 1 micron;

spreading fine abrasive grains and a processing liquid over the plastic film of the polishing disc, the abrasive grains being retained by the rough surface;

pressing the optical fiber against the polishing disc; and causing a relative movement between the tip end surface and the polishing disc.

6. The method defined in claim 5, wherein the fine abrasive grains have a size of 0.5 μm or less.

7. The method defined in claim 5, wherein the abrasive grains include one of a fine powder of alumina, a powder of oxide silica, and a powder of silica.

8. A polishing disc for polishing a tip end surface of an optical fiber into a spherical shape, the optical fiber being supported by a ferrule, the polishing disc comprising:

a flat base plate comprised of an elastic material, and a soft, abrasive-free plastic film adhered to said flat base plate, and having a rough surface formed by a rugged pattern, the rough surface having a surface roughness of 0.2 to 1 micron for retaining an abrasive powder supplied to said polishing disc, wherein the tip end surface of the optical fiber is polished by pressing the optical fiber against the polishing disc, and causing a relative movement between the tip end surface and the polishing disc.

* * * * *